US006085385A

United States Patent [19]

Joo

[11] Patent Number: 6,085,385

[45] Date of Patent: Jul. 11, 2000

[54] UPPER HINGE FRAME FOR REFRIGERATOR

[75] Inventor: Pil Don Joo, Changwon, Rep. of Korea

[73] Assignee: LG Electronics Inc., Rep. of Korea

[21] Appl. No.: 09/007,686

[22] Filed: Jan. 15, 1998

[30] Foreign Application Priority Data

Oct. 9, 1997 [KR] Rep. of Korea ..... 97-51787

[51] Int. Cl.[7] ..... E05D 1/06

[52] U.S. Cl. ..... 16/268; 16/262; 16/382; 16/271

[58] Field of Search ..... 16/268, 257, 258, 16/261, 263, 266, 270, 271, 380, 382; 312/326, 405; 49/381, 397, 388

[56] References Cited

U.S. PATENT DOCUMENTS

| | | | |
|---|---|---|---|
| 1,087,576 | 2/1914 | Fernald | 16/257 |
| 2,603,822 | 7/1952 | Evans | 16/262 |
| 4,416,086 | 11/1983 | Niekrasz . | |
| 4,610,489 | 9/1986 | Dibert, Jr. et al. | 16/262 |
| 4,691,408 | 9/1987 | Rock et al. | 16/382 |
| 5,343,595 | 9/1994 | Lautenschlager . | |
| 5,870,801 | 2/1999 | Kim | 16/267 |
| 5,884,366 | 3/1999 | Jeong | 16/271 |

FOREIGN PATENT DOCUMENTS 2028914 5/1979 United Kingdom .

*Primary Examiner*—Chuck Y. Mah
*Attorney, Agent, or Firm*—Ostrolenk, Faber, Gerb & Soffen, LLP

[57] ABSTRACT

An upper hinge frame of a refrigerator, capable of firmly supporting a refrigerator door, thus preventing a refrigerator from having a gap between the door and a main body thereof, includes: a hinge supporting body formed at a front edge of a top surface of the main body as a single body and each end portion of which is downwardly bent by 90 degrees and an end portion thereof is again outwardly bent by 90 degrees; an upper hinge of a flat board shape downwardly inserted into a portion of the hinge supporting body, and having an inserting portion which is rearwardly protruded from a rear end thereof and inserted into an insertion hole of the hinge supporting body, and having a front end part of a circular arc shape formed by which each side thereof is incurvated; and a hinge attaching lever downwardly inserted into the upper hinge thereby connecting the upper hinge to the hinge supporting body, and having a lower end portion which is downwardly bent by 90 degrees, thus forming a L-shape.

5 Claims, 6 Drawing Sheets

UPPER HINGE FRAME FOR REFRIGERATOR

BACKGROUND OF THE INVENTION

1. Field of the Invention

The present invention relates to a refrigerator, and in particular to an improved upper hinge frame for a refrigerator capable of firmly supporting a refrigerator door, thus preventing a refrigerator from having a gap between the door and a main body thereof.

2. Description of the Conventional Art

Generally, as shown in FIG. 1, a refrigerator is mainly composed of a main body 10 for storing foods, a door 30 movably fixed to the main body 10 and opening/closing an interior of the refrigerator, and a hinge frame unit 50 for fixedly supporting the door 30 so as for the door 30 to be movably fixed to the main body 30.

The hinge frame unit 50 includes an upper hinge frame 500 fixedly connected with a front edge of a top surface of the main body 10 and fixedly supporting the door 30 from the top so that the door 30 may be rotatable, and a lower hinge frame 600 fixedly connected with a front edge of a bottom surface of the main body 10 and fixedly supporting the door 30 from the bottom so that the door 30 may be rotatable.

As shown in FIG. 2, the upper hinge frame 500 includes: a hinge supporting body 510 of a plate shape formed at the front edge of the top surface of the main body 10 as a single body; an upper hinge 530 downwardly fitted to the hinge supporting body 510 and having a connecting portion 531 which is protruded from a rear end portion thereof and inserted into a portion of the hinge supporting body 510, and having one side thereof which is incurvated; and a ¬-shape hinge attaching lever 550 downwardly fitted to the upper hinge 530 and thus connecting the upper hinge 530 and the main body 10.

The hinge supporting body 510 includes a pair of connecting holes 511 which are formed lengthwise in a center part thereof, and a pair of ⊏-type connection control portions 513 which are formed lengthwise in an upright position at right and left sides of the connecting holes 511, each of which has a connecting groove 513*a* so as to receive the hinge attaching lever 550.

In addition, at a rear end portion of the hinge supporting body 510, a link portion 515 having an insertion hole 515*a* in a center part thereof is erectly formed in order to receive the connecting portion 531 of the upper hinge 530.

The upper hinge 530 includes a pair of connecting protrusions 533 which are downwardly protruded from a center portion of a lower surface thereof so as to respectively correspond to the connecting holes 511 of the hinge supporting body 510, and a hinge pin 535 which is downwardly protruded from a center part of a front end portion of a lower surface thereof so as to support the door 30 to rotatably move by being inserted into a hinge groove (not shown) formed at the door 30.

The hinge attaching lever 550 includes: an operation lever 551 of a plate shape so as for an user to simply handle the lever; an attaching plate 553 formed by which one end portion of the operation lever 551 is downwardly bent by 90 degrees and tightly attaching or separating the upper hinge 530 to/from the hinge supporting body 510 in accordance with a rotation of the operation lever 551; and a connecting protrusion 553*a* which is widthwise protruded from each side portion of the attaching plate 553 so as to be rotatably inserted into the corresponding connecting groove 513*a* of the connection control portions 513 disposed at the hinge supporting body 510.

An operation for combining each unit of the conventional upper hinge frame 500 will be described with reference to the accompanying drawings.

As shown in FIGS. 1 to 3A, first, the connecting portion 531 protruded from the rear end portion of the upper hinge 530 is inserted into the link portion 515 of the hinge supporting body 510 formed at the front edge of the top surface of the main body 10 as a single body, and simultaneously the pair of connecting protrusions 533 downwardly protruded from the center portion of the lower surface of the upper hinge 530 are respectively inserted into the pair of connecting holes 511 formed at the hinge supporting body 510, for thereby connecting the upper hinge 530 to the hinge supporting body 510.

Next, the connecting protrusion 553*a* which is widthwise protruded from each side portion of the attaching plate 553 of the hinge attaching lever 550 is inwardly inserted into the corresponding connecting grooves 513*a* of the hinge supporting body 510, on condition that the operation lever 551 of the hinge attaching lever 550 is vertically in an upward position, and the operation lever 551 is downwardly rotated by 90 degrees towards the link portion 515 of the hinge supporting body 510.

Here, when the operation lever 551 is downwardly rotated by 90 degrees, the attaching plate 553 presses down the upper hinge 530 while rotating, and thus the upper hinge 530 is tightly attached to the hinge supporting body 510.

The hinge pin 535 which is downwardly protruded from the center of the front end portion of the upper hinge 530 is inserted into the hinge groove (not shown) formed at the door 30, thereby completing the operation for combining each of the conventional upper hinge frame 500.

FIG. 3B illustrates the upper hinge 530 is being separated from the hinge supporting body 510 by which the operation lever 551 of the hinge attaching lever 550 is upwardly rotated by 90 degrees. Here, since an operation for separating the upper hinge 530 from the hinge supporting body 510 is carried out in an opposite order of the operation for combining the upper hinge 530 and the hinge supporting body 510, the description therefor will be omitted.

However, in the conventional upper hinge frame, a distance between the connecting protrusion and each corner of the attaching plate, which presses and tightly attaches the upper hinge to the hinge supporting body, is fixed, and the attaching plate is a plate-shape formed by which one end portion of the operation lever is downwardly bent by 90 degrees, thus the upper hinge is not firmly attached to the hinge supporting body.

Accordingly, a gap between the main body and the door is made in the course of time, and therefore unnecessary power is consumed.

SUMMARY OF THE INVENTION

Accordingly, it is an object of the present invention to provide an upper hinge frame of a refrigerator capable of firmly supporting a refrigerator door, thus preventing a refrigerator from having a gap between the door and a main body thereof.

To achieve the above objects, there is provided an upper hinge frame of a refrigerator according to the present invention which includes: a hinge supporting body formed at a front edge of a top surface of the main body as a single body and each end portion of which is downwardly bent by 90 degrees and an end portion thereof is again outwardly bent by 90 degrees; an upper hinge of a flat board shape downwardly inserted into a portion of the hinge supporting body, and having an inserting portion which is rearwardly protruded from a rear end thereof and which is inserted into an insertion hole of the hinge supporting body, and having a front end part of a circular arc shape formed by which each side thereof is incurvated; and a hinge attaching lever downwardly inserted into the upper hinge and connecting the upper hinge to the main body, and having a lower end portion which is downwardly bent by 90 degrees, thus forming a L-shape.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

With reference to the accompanying drawings, an embodiment of an upper hinge frame of a refrigerator according to the present invention will now be described.

Here, the elements which are the same as those of the conventional art are labelled with the same reference numbers.

Figure 1:
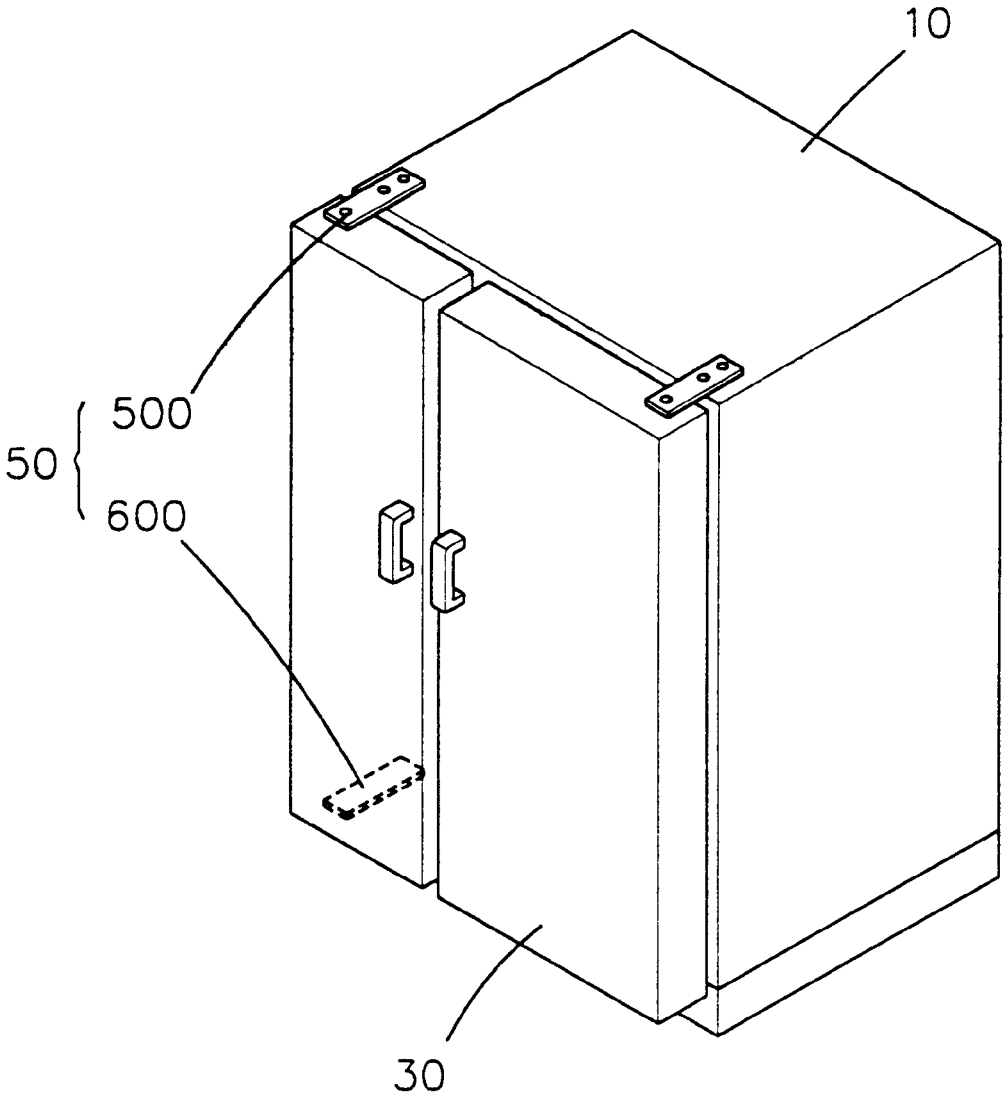
FIG. 1 CONVENTIONAL ART
FIG. 1 is a perspective view of a refrigerator.
Figure 2:
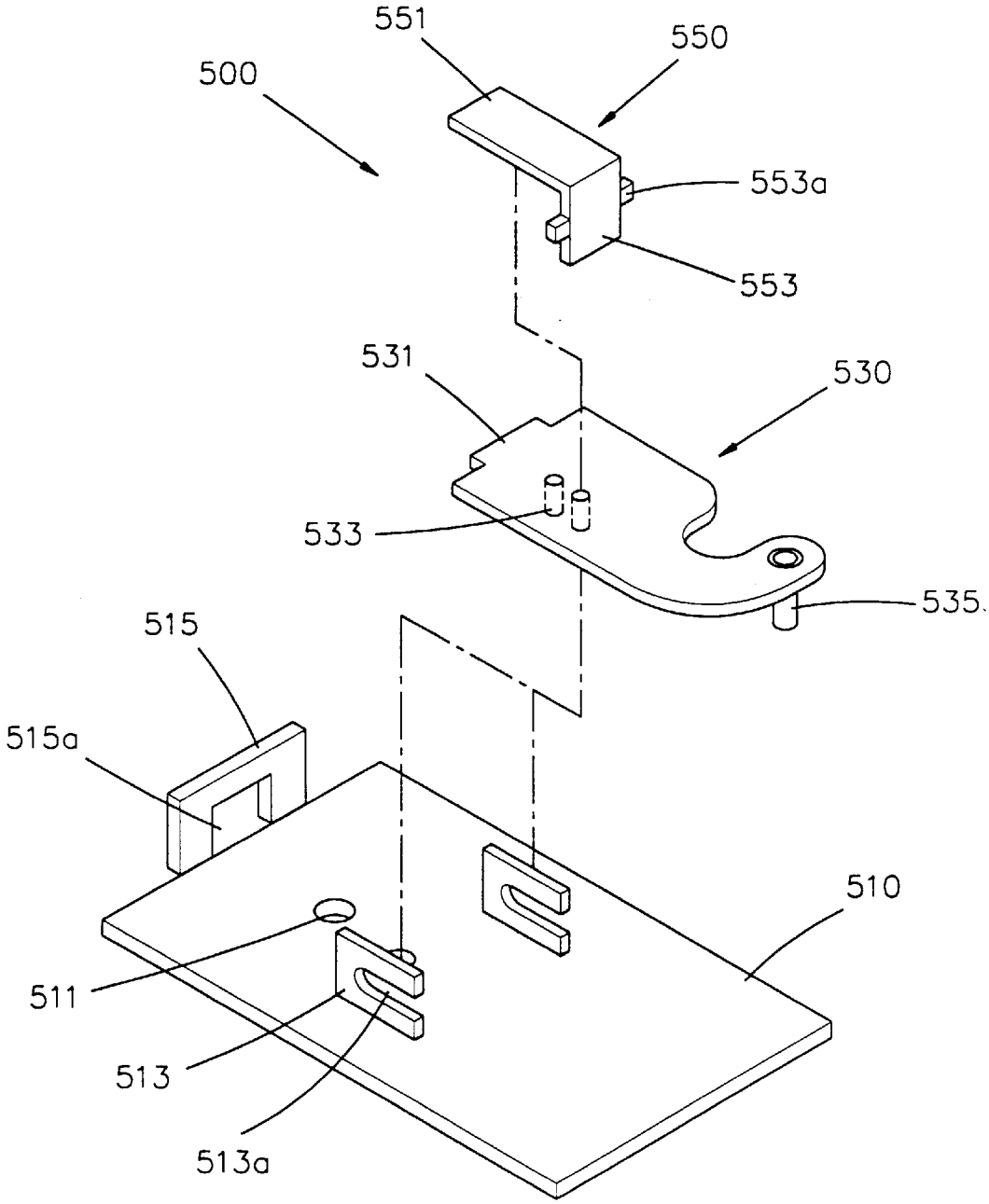
FIG. 2 CONVENTIONAL ART
FIG. 2 is a separate perspective diagram illustrating each unit of a conventional upper hinge frame for a refrigerator.
Figure 3A:
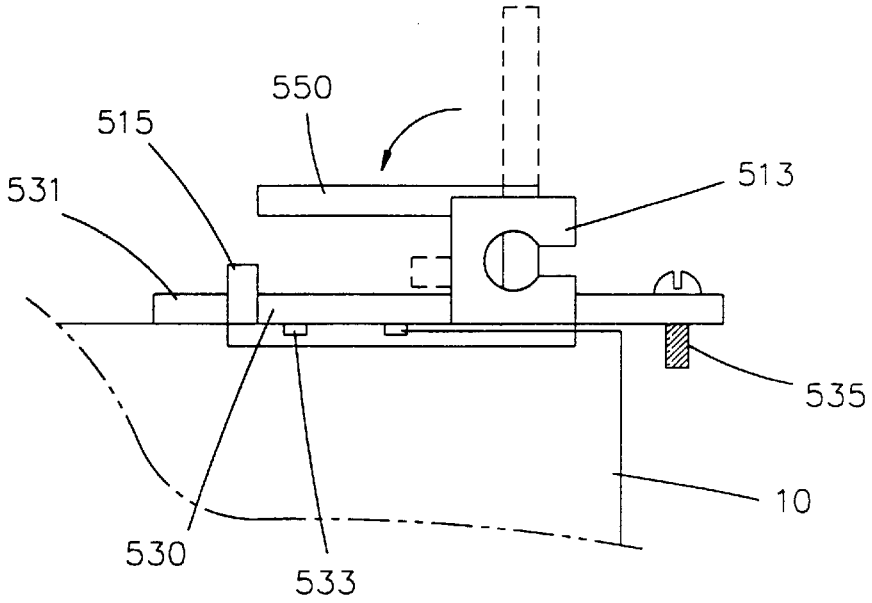
FIG. 3A CONVENTIONAL ART
FIG. 3A is a side cross-sectional diagram illustrating an upper hinge being attached to a hinge supporting body by which an operation lever of a hinge attaching lever is downward rotated by 90 degrees.
Figure 3B:
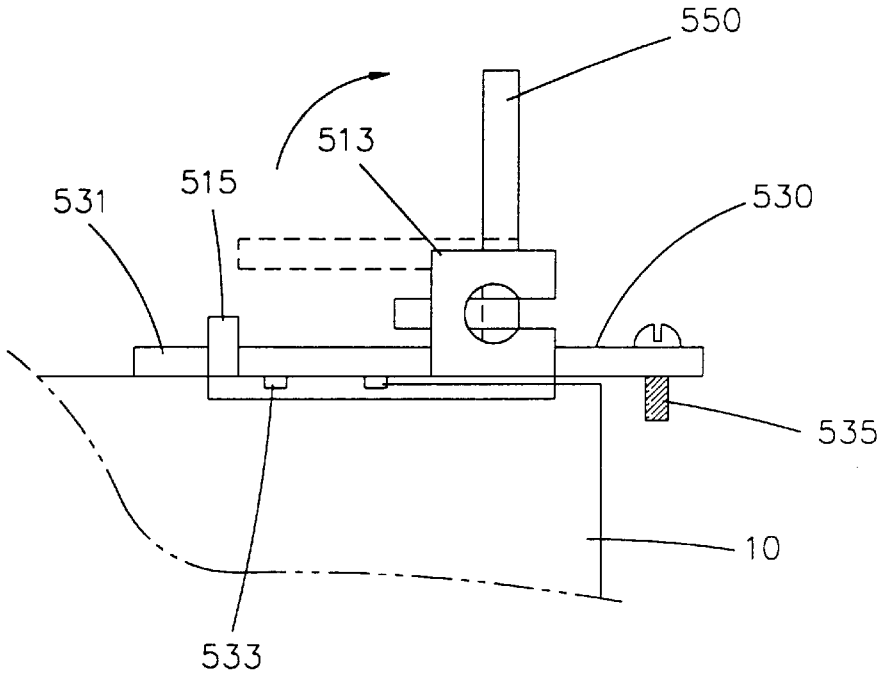
FIG. 3B CONVENTIONAL ART
FIG. 3B is a side cross-sectional diagram illustrating the upper hinge being separated from the hinge supporting body by which the operation lever of the hinge attaching lever is upwardly rotated by 90 degrees.
Figure 4:
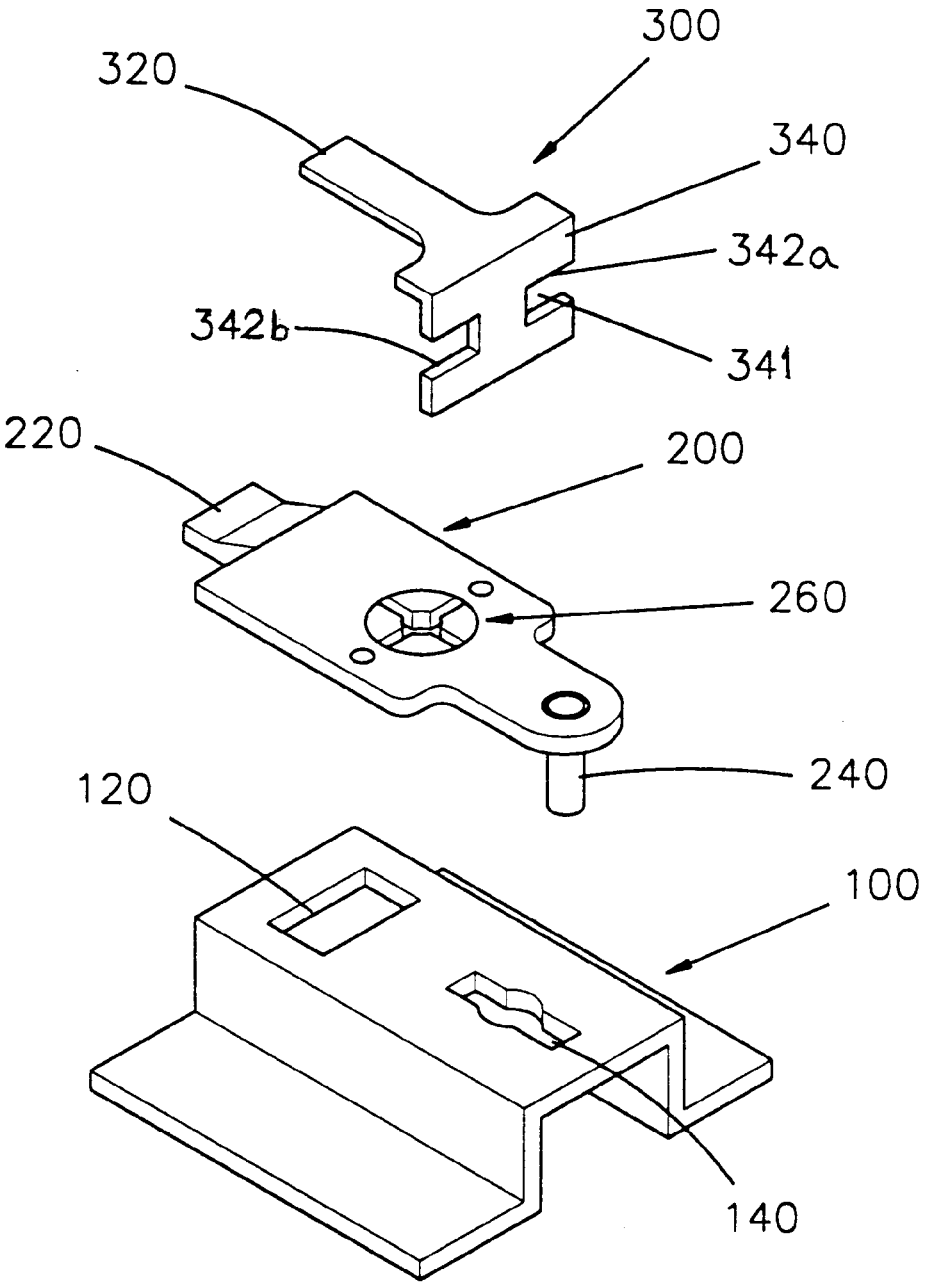
FIG. 4 is a separate perspective diagram illustrating each unit of an upper hinge frame for refrigerator according to the present invention.

FIG. 4 illustrates each unit of an upper hinge frame for a refrigerator according to the present invention. As shown therein, the upper hinge frame includes: a hinge supporting body 100 fixed to a front edge of a top surface of the main body as a single unit and each end portion of which is downwardly bent by 90 degrees and an end portion thereof is again outwardly bent by 90 degrees; an upper hinge 200 of a flat board-shape downwardly inserted into a portion of the hinge supporting body 100, and having an inserting portion 220 which is rearwardly protruded from a rear end thereof and which is inserted into an insertion hole 120 of the hinge supporting body 100, and having a front end part of a circular arc shape formed by which each side thereof is curved; and a L-shape hinge attaching lever 300 downwardly inserted into the upper hinge 200, and connecting the upper hinge to the hinge supporting body 100, and having a lower end portion which is downwardly bent by 90 degrees.

The hinge supporting body 100 is provided with the rectangular insertion hole 120 which is formed at a center of a rear end part of an upward protruding portion thereof so as to receive the inserting portion 220 which is rearwardly protruded from the rear end of the upper hinge, and a first fastening hole 140 which is lengthwise formed at a predetermined length in front of the insertion hole 120 so as to receive the hinge attaching lever 300.

Here, the first fastening hole 140 is formed in the shape of a cross, and a lengthwise direction thereof is long and a widthwise direction thereof is short compared with the lengthwise direction so that the hinge attaching lever 300 can be inserted thereinto only at the lengthwise direction.

The upper hinge 200 is provided with a hinge pin 240 which is downwardly protruded from a center part of a front end portion of a lower surface thereof so as to support a refrigerator door to rotatably move by being inserted into a hinge groove (not shown) formed at the door, and a fastening member 260 disposed at the back side of the hinge pin 240 in order to correspond to a location of the first fastening hole 140, thereby fastening the upper hinge 200 to the hinge supporting body 100.

Figure 5:
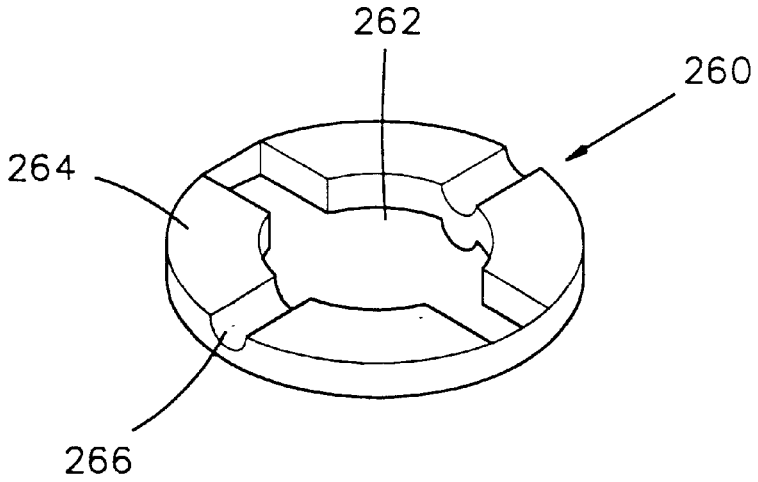
FIG. 5 is a detail diagram illustrating a fastening member of an upper hinge frame for a refrigerator according to the present invention.
Figure 6:
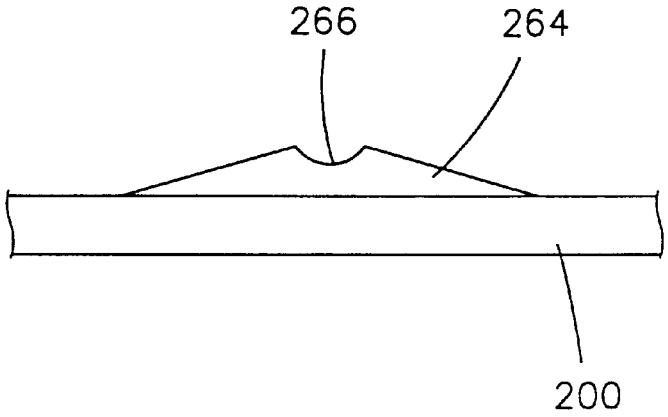
FIG. 6 is a side cross-sectional view illustrating the fastening member of the upper hinge frame for a refrigerator according to the present invention.

As shown in FIG. 5, the fastening member 260 includes a second fastening hole 262 of which a length is long and a width is short compared to the length so that the hinge attaching lever can be inserted thereinto in a lengthwise direction, an inclined portion 264 having upward inclination at an angle of certain degrees toward each point where the second fastening hole 262 has the shortest diameter, and a fastening groove 266 formed on a top portion of the inclined portion 264 along a portion of an edge line thereof.

The hinge attaching lever 300 includes an operation handle 320 of a plate type so as for a user to grip the handle, and an attaching plate 340 formed by which one end portion of the operation handle 320 is downwardly bent by 90 degrees, and inserted into the first fastening hole 140 and the second fastening hole 262, which are formed at the hinge supporting body 100 and the upper hinge 200, respectively.

Each side of a center portion of the attaching plate 340 is inwardly engraved so as to for the upper hinge 200 and hinge supporting body 100 to be fitted thereinto, and thus the attaching plate 340 formes a fixing groove 342 of which a front cross-sectional view is a shape of which a H-type is rotated by 90 degrees.

An operation for combining each unit of the upper hinge frame according to the present invention will be described with reference to the accompanying drawings.

Figure 7:
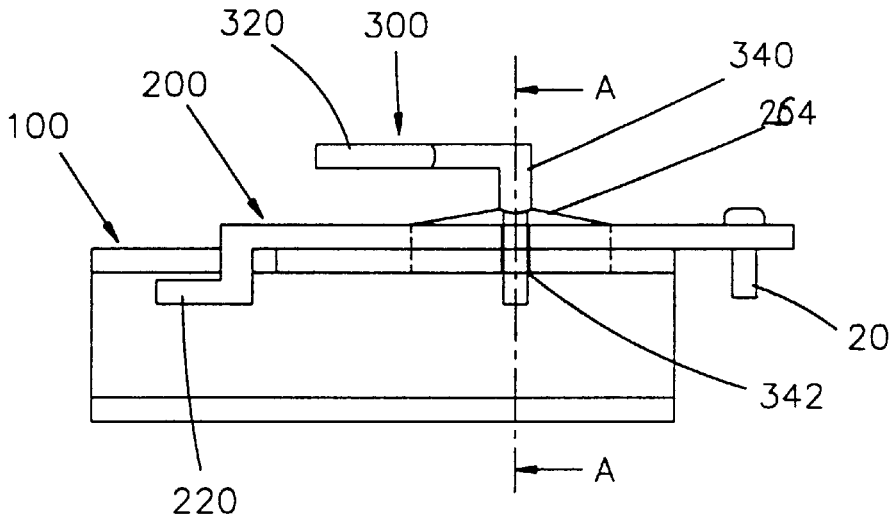
FIG. 7 is a side cross-sectional view illustrating each unit of the upper hinge frame being connected to each other according to the present invention.
Figure 8:
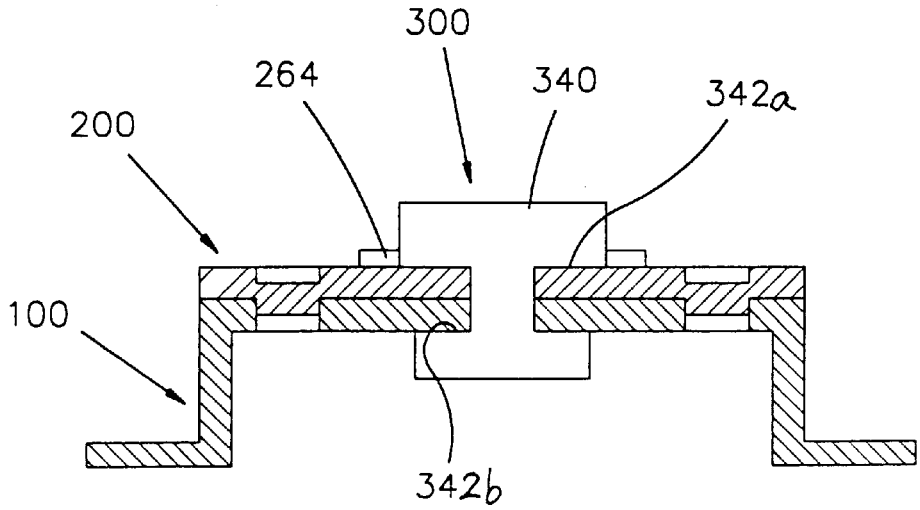
FIG. 8 is a vertical cross-sectional view taken along the line A–A' of FIG. 7.

As shown in FIGS. 7 and 8, the inserting portion 220 of the upper-hinge is inserted into the insertion hole of the hinge supporting body 100 fixed to the front edge of the top surface of the main body as a single unit, thus connecting the upper hinge 200 with the hinge supporting body 100.

Next, in order to attach a lower portion 341*b* of the fixing groove 341 formed at the attaching plate 340 of the hinge attaching lever 300 to a lower surface of the hinge supporting body 100, and to attach an upper portion 341*a* of the fixing groove 341 thereat to an upper surface of the upper hinge 200, the attaching plate 340 of the hinge attaching lever 300 is inserted into the first fastening hole 140 and second fastening hole 262, formed at the hinge supporting body 100 and upper hinge 200, respectively, and is horizontally rotated by 90 degrees, thus fixedly attaching the upper hinge 200 to the hinge supporting body 100.

Here, when the attaching plate 340 of the hinge attaching lever 300 is horizontally rotated by 90 degrees, the upper portion 341*a* of the fixing groove 341 formed at the attaching plate 340 moves along the inclined portion 264 of the fastening member 260 formed on an upper surface of the upper hinge 200 and fastened in the fastening groove 266 formed on the top portion of the inclined portion 264 along a portion of an edge line thereof, and the lower portion 341*b* of the fixing groove 341 is tightly attached to the lower surface of the hinge supporting body 100, thus the upper hinge 200 is fixedly coupled with the hinge supporting body 100.

That is, when the attaching plate 340 of the hinge attaching lever 300 vertically rotates by 90 degrees, the upper hinge 200 and hinge supporting body 100 are fitted into the fixing groove 341. Accordingly, the lower portion 341*b* of the fixing groove 341 is closely faced with the lower surface of the hinge supporting body 100, and the upper portion 341*a* of the fixing groove 341 is closely faced with the upper surface of the upper hinge 200, and therefore the upper hinge 200 is firmly attached to the upper surface of the hinge supporting body 100 without being loosened.

Next, the hinge pin 240 of the upper hinge 200 in inserted into the hinge groove (not shown) formed at the door, for thus completing the operation for combining each unit of the upper hinge frame according to the present invention.

since an operation for separating each unit of the upper hinge frame according to the present invention is carried out in an opposite order of the operation for combining each unit thereof, the description therefor will be omitted.

As described above, the hinge attaching lever of the upper hinge frame according to the present invention is inserted into the upper hinge and hinge supporting body, and horizontally rotated, and thus fastened in the fastening groove of the upper hinge, thereby fixedly attaching the upper hinge with the hinge supporting body, and accordingly preventing the refrigerator from having a gap between the door and the main body thereof.

Although the preferred embodiment of the present invention has been disclosed for illustrative purposes, those skilled in the art will appreciate that various modifications, additions and substitutions are possible, without departing from the scope and spirit of the invention as recited in the accompanying claims.

What is claimed is:

1. An upper hinge frame for a refrigerator, comprising:

a hinge supporting body formed as a single piece member and including a horizontal midsection, and extending from the horizontal midsection, a pair of end portions each of which is downwardly bent by 90° and again outwardly by 90° relative to the horizontal midsection, thus forming a rectangular clamp, the midsection having an insertion hole formed adjacent a rear part thereof;

an upper hinge engaged with the midsection of the hinge supporting body, the upper hinge having an inserting portion which is shaped to be received within the insertion hole of the midsection of the hinge supporting body, in a manner such that the inserting portion engages an undersurface of the midsection, the upper hinge having a front end part for supporting a door of the refrigerator;

a first elongated fastening hole formed in the midsection of the hinge supporting body;

a second elongated fastening hole in the upper hinge, the second fastening hole of the upper hinge being in registration with the first fastening hole of the hinge supporting body; and a generally L-shaped, hinge attaching lever comprising a handle and an attaching plate extending at 90° relative to the handle, the attaching plate being engraved and insertable through the first fastening hole and the second fastening hole and rotatable to lock the upper hinge to the hinge supporting body.

2. The frame of claim 1, wherein the insertion hole in the midsection is rectangularly shaped.

3. The frame of claim 2, wherein the first fastening hole is formed in a cross shape, and a lengthwise direction thereof is long and a widthwise direction thereof is short compared with the lengthwise direction so that the hinge attaching lever can be inserted thereinto only at the lengthwise direction.

4. The frame of claim 1, wherein the upper hinge comprises:

a hinge pin which extends downwardly from a lower surface of the front end part of the upper hinge so as to support the refrigerator door to rotatably move by being inserted into a hinge groove formed at the door.

5. The frame of claim 4, wherein the upper hinge includes a fastening member, in which the second fastening hole is formed, and having;

an inclined portion inclined upwardly toward the second fasting hole; and a fastening groove formed on a top portion of the inclined portion and leading to the second fastening hole.

* * * * *